US006619811B2

(12) United States Patent
Wang et al.

(10) Patent No.: US 6,619,811 B2
(45) Date of Patent: Sep. 16, 2003

(54) CUP SHOWING LUMINOUS IMAGES

(76) Inventors: Chun-Hsien Wang, 29Fl-1, No. 12, Pao Ching Street, Shin Tien City, Taipei Hsien (TW); Ting-Yue Hwu, No. 20, Lane 59, Sec. 1, Nan Chang Rd., Taipei (TW)

( * ) Notice: Subject to any disclaimer, the term of this patent is extended or adjusted under 35 U.S.C. 154(b) by 22 days.

(21) Appl. No.: 09/986,490

(22) Filed: Nov. 9, 2001

(65) Prior Publication Data

US 2003/0090891 A1 May 15, 2003

(51) Int. Cl.[7] ..... F21V 33/00; F21V 9/16

(52) U.S. Cl. ..... 362/101; 362/84; 362/562; 362/154; 362/802

(58) Field of Search ..... 362/84, 101, 812, 362/562, 154, 806, 802, 276; 40/542, 544; 215/228, 230

(56) References Cited

U.S. PATENT DOCUMENTS 6,213,616 B1 * 4/2001 Chien ..... 362/84

6,443,589 B1 * 9/2002 Lee ..... 362/101

* cited by examiner

*Primary Examiner*—Sandra O'Shea
*Assistant Examiner*—Bao Q. Truong
(74) *Attorney, Agent, or Firm*—Rosenberg, Klein & Lee

(57) ABSTRACT

A cup includes a transparent body having an inner and an outer wall to define an annular hollow space between them, a bottom sealing a lower end of the body and the annular hollow space, an open-bottomed chamber formed below the body to communicate with the annular hollow space via an opening provided on the bottom, a luminous strip with printed pictures, words or patterns enclosed in the annular hollow space, a driving circuit mounted in the chamber to electrically connect to the luminous strip and parallelly connected to a vibrating-type switch, and a lower cover detachably closing the chamber. When the cup is vibrated to make the vibrating-type switch, the luminous strip is lightened for the pictures, words or patterns to produce cold light that is refracted by the outer wall of the body to show three-dimensional images on the cup.

2 Claims, 5 Drawing Sheets

CUP SHOWING LUMINOUS IMAGES

BACKGROUND OF THE INVENTION

The present invention relates to a cup showing pictures, words or patterns thereon, and more particularly to a cup showing luminous pictures, words or patterns that create three-dimensional visual effect to increase the value of the cup.

A most common way to decorate a cup and thereby increase the value thereof is to provide pictures, words or patterns on the surface of the cup by way of printing and/or kilning. The pictures, words or patterns formed on the cup by printing or kilning are visible only at well-lightened places and are always two-dimensional images. In a dark or poor-lightened place, such printed or kilned pictures, words or patterns could not be clearly viewed and completely lose their function of decorating the cup.

SUMMARY OF THE INVENTION

It is therefore a primary object of the present invention to provide a cup capable of showing luminous images that are visible even in a dark place, enabling the cup to serve as a good ornament or advertising article and therefore has increased value.

To achieve the above and other objects, the cup of the present invention includes a transparent body having an inner and an outer wall to define an annular hollow space between them, a bottom sealing a lower end of the body and the annular hollow space, an open-bottomed chamber formed below the body to communicate with the annular hollow space via an opening provided on the bottom, a luminous strip with printed pictures, words or patterns enclosed in the annular hollow space, a switch-controlled driving circuit mounted in the chamber and electrically connected to the luminous strip via conductors extended through the opening on the bottom, and a lower cover detachably closing the chamber.

In the present invention, the driving circuit mounted in the chamber is provided with a vibrating-type switch. When the cup is vibrated, the vibrating-type switch is made to lighten the luminous strip for the pictures, words or patterns to produce cold light. The cold light passes through and is refracted by the outer wall of the cup body to show luminous three-dimensional images on the cup.

The open-bottomed chamber is provided at a lower peripheral wall with screw threads meshing with screw threads provided at an upper peripheral wall of the lower cover, so that the lower cover is screwed onto the chamber to isolate the latter from external humidity and to facilitate replacement of batteries of the driving circuit.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
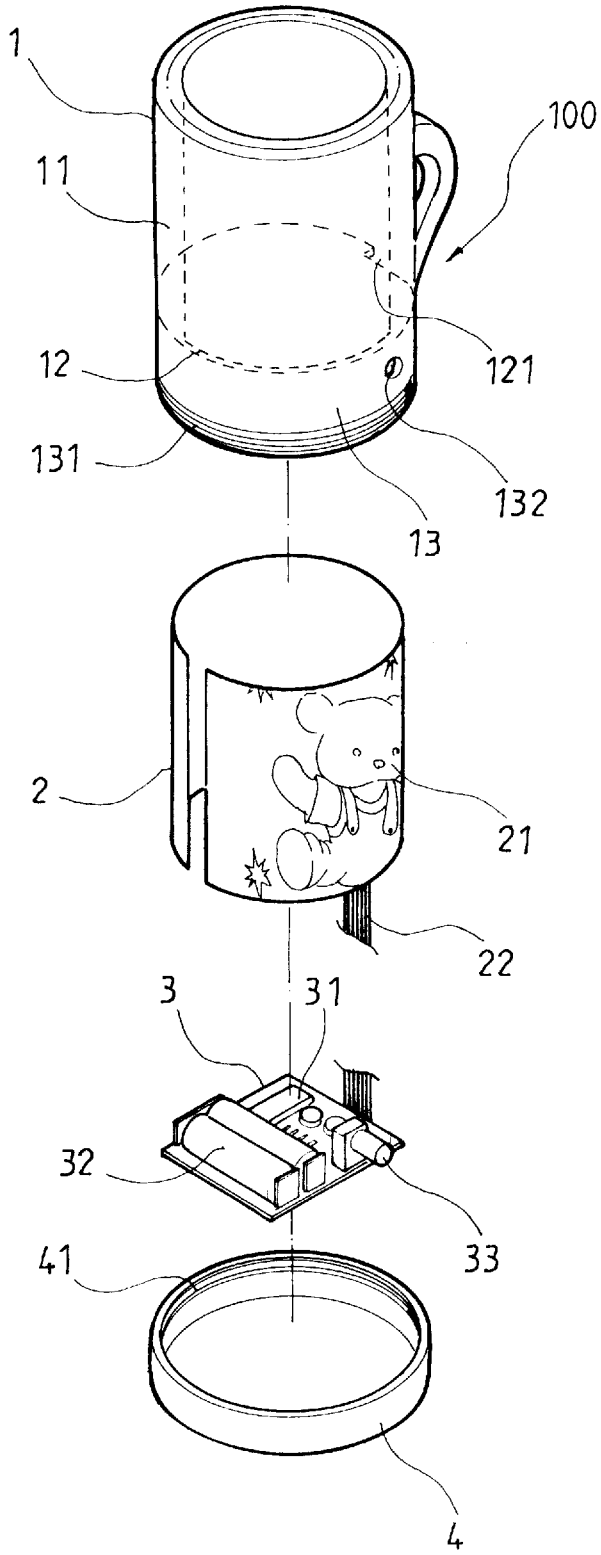
FIG. 1 is an exploded perspective view of a cup according to the present invention.

Please refer to FIG. 1 that is an exploded perspective view of a cup 100 according to the present invention. As shown, the cup 100 mainly includes a transparent double-walled body 1 that has an inner and an outer wall to define an annular hollow space 11 between them, and a bottom 12 sealing a lower end of the body 1, including the annular hollow space 11. The outer wall of the body 1 downward extends from the bottom 12 by a predetermined distance to form an open-bottomed hollow chamber 13 below the body 1. An elongated opening 121 is left on the bottom 12 to communicate the annular hollow space 11 with the chamber 13. The chamber 13 is provided around a lower outer periphery with external threads 131 and on its wall at a suitable point with a through hole 132.

A luminous strip 2 that may be printed with different pictures, words or patterns 21 is enclosed in the annular hollow space 11 of the body 1 before the inner and the outer walls are sealed by means of, for example, supersonic wave or other suitable bonding manners. The luminous strip 2 includes conductors 22 that are guided through the elongated opening 121 on the bottom 12 into the chamber 13.

A driving circuit 3 including a necessary electronic component 31, batteries 32, and a power switch 33 is received in the chamber 13, so that the circuit 3 is electrically connected to the conductors 22 of the luminous strip 2. The power switch 33 is partially exposed from the through hole 132 on the wall of the chamber 13 to be conveniently pushed by a user to actuate the driving circuit 3. The driving circuit 3 also includes a vibrating-type switch 34 that will be described in more details later.

A lower cover 4 provided with internal threads 41 is screwed onto the chamber 13 to mesh the internal threads 41 with the external threads 131 and thereby complete the cup 100 of the present invention.

After the power switch 33 has been turned on, a vibrated cup 100 would make the vibrating-type switch to actuate the driving circuit 3 and thereby lighten the luminous strip 2 in the annular hollow space 11, and cold light is produced at the pictures, words or patterns 21 on the luminous strip 2.

Figure 2:
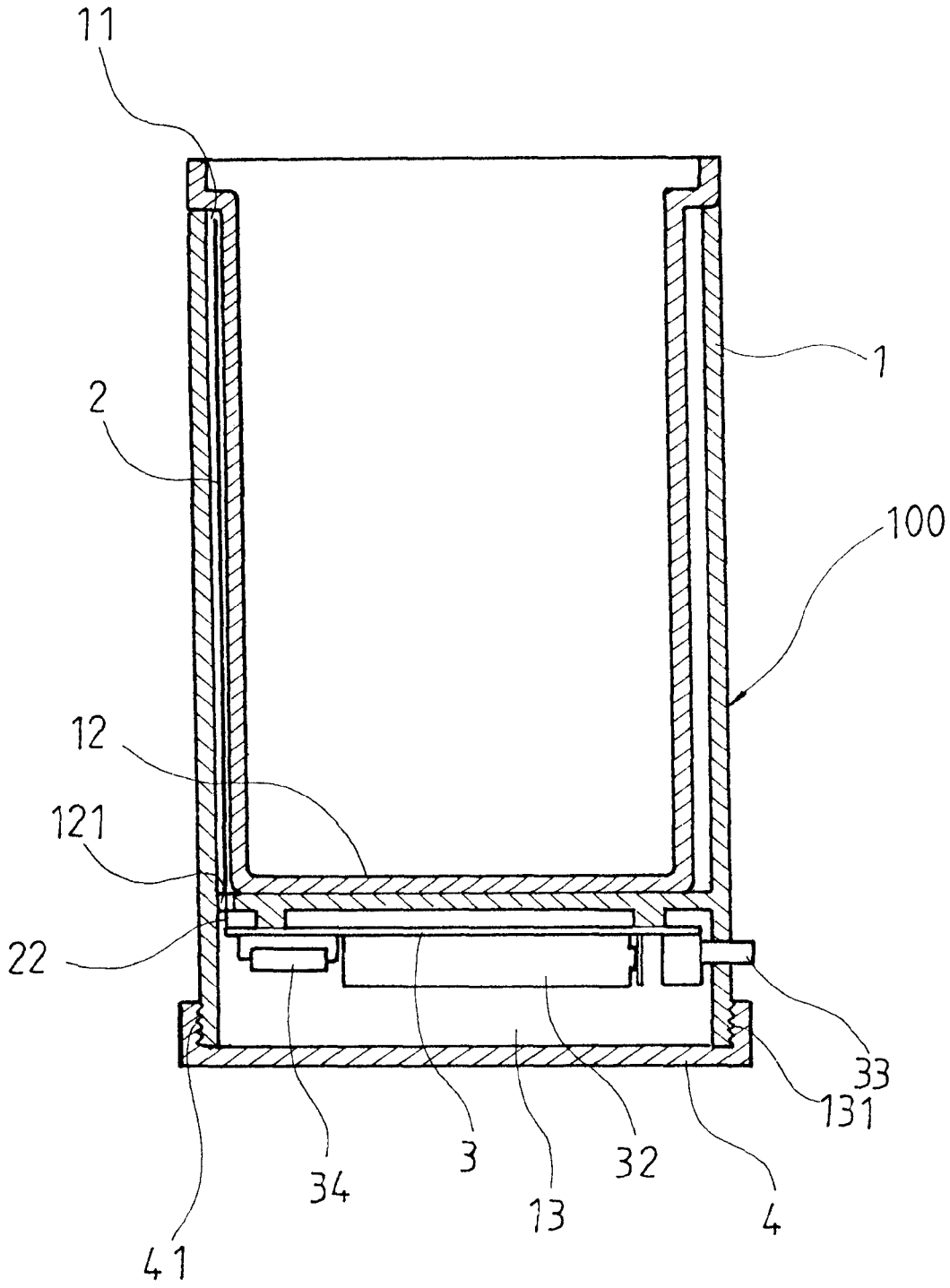
FIG. 2 is an assembled sectional view of the cup of the present invention.

Please refer to FIG. 2 that is an assembled sectional view of the cup of the present invention. The luminous strip 2 is enclosed in the annular hollow space 11 of the body 1, and the driving circuit 3 is mounted in the chamber 13 and electrically connected to the luminous strip 2 via the conductors 22. As mentioned above, the driving circuit 3 includes a vibrating-type switch 34. When the power switch 33 is in an Off position, the luminous strip 2 is not lightened and the pictures, words or patterns 21 on the luminous strip 2 are seen through the body 1 to provide a visual effect similar to that provided by general pictures. And, when the power switch 33 is pushed to an On position and the cup 100 is vibrated to make the vibrating-type switch 34, the luminous strip 2 is lightened and cold light produced by the pictures, words or patterns 21 is refracted by the outer wall of the body 1 when it passes therethrough, creating three-dimensional images on the cup 100.

Figure 3:
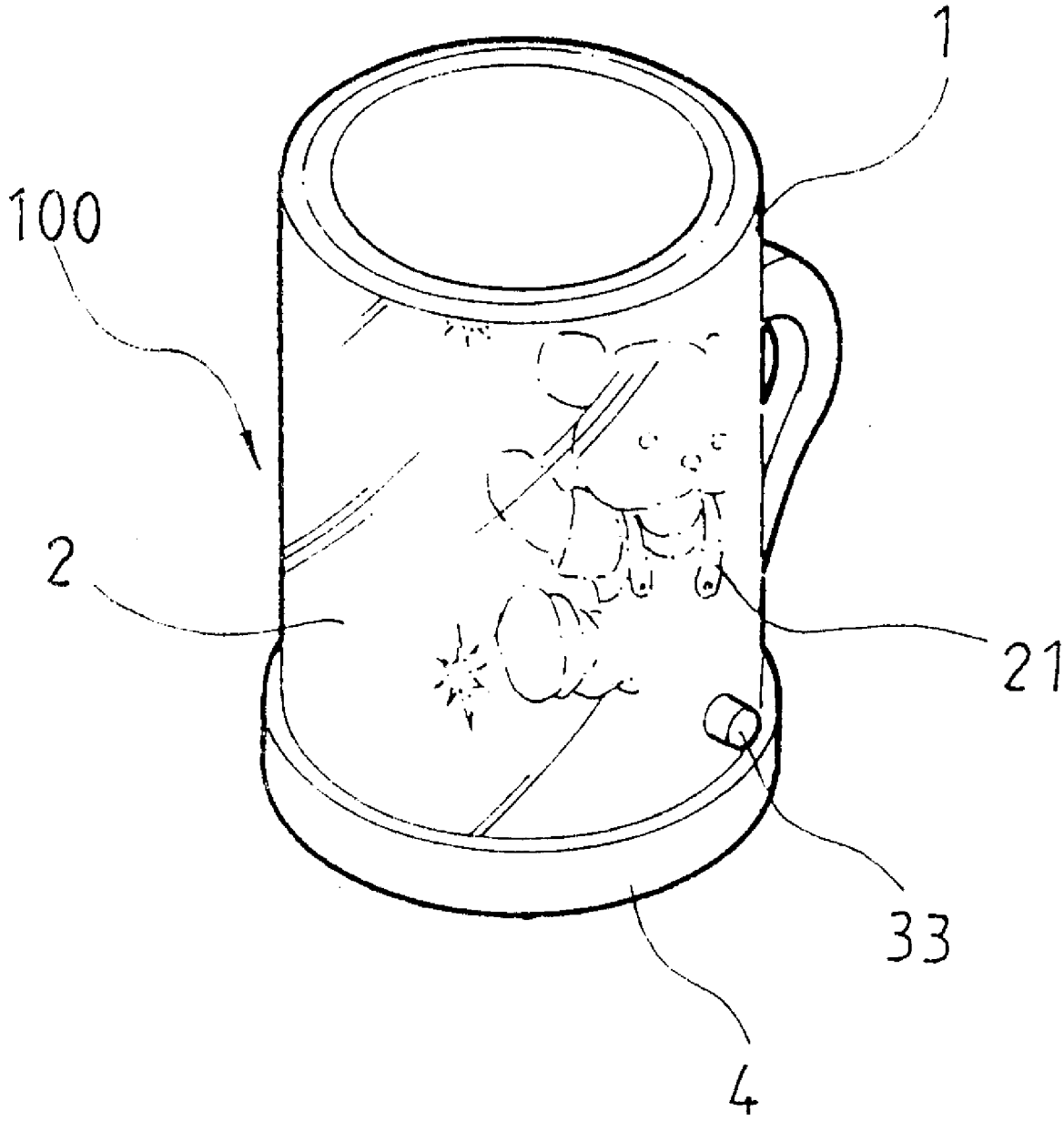
FIG. 3 is an assembled perspective view of the cup of the present invention.
Figure 4:
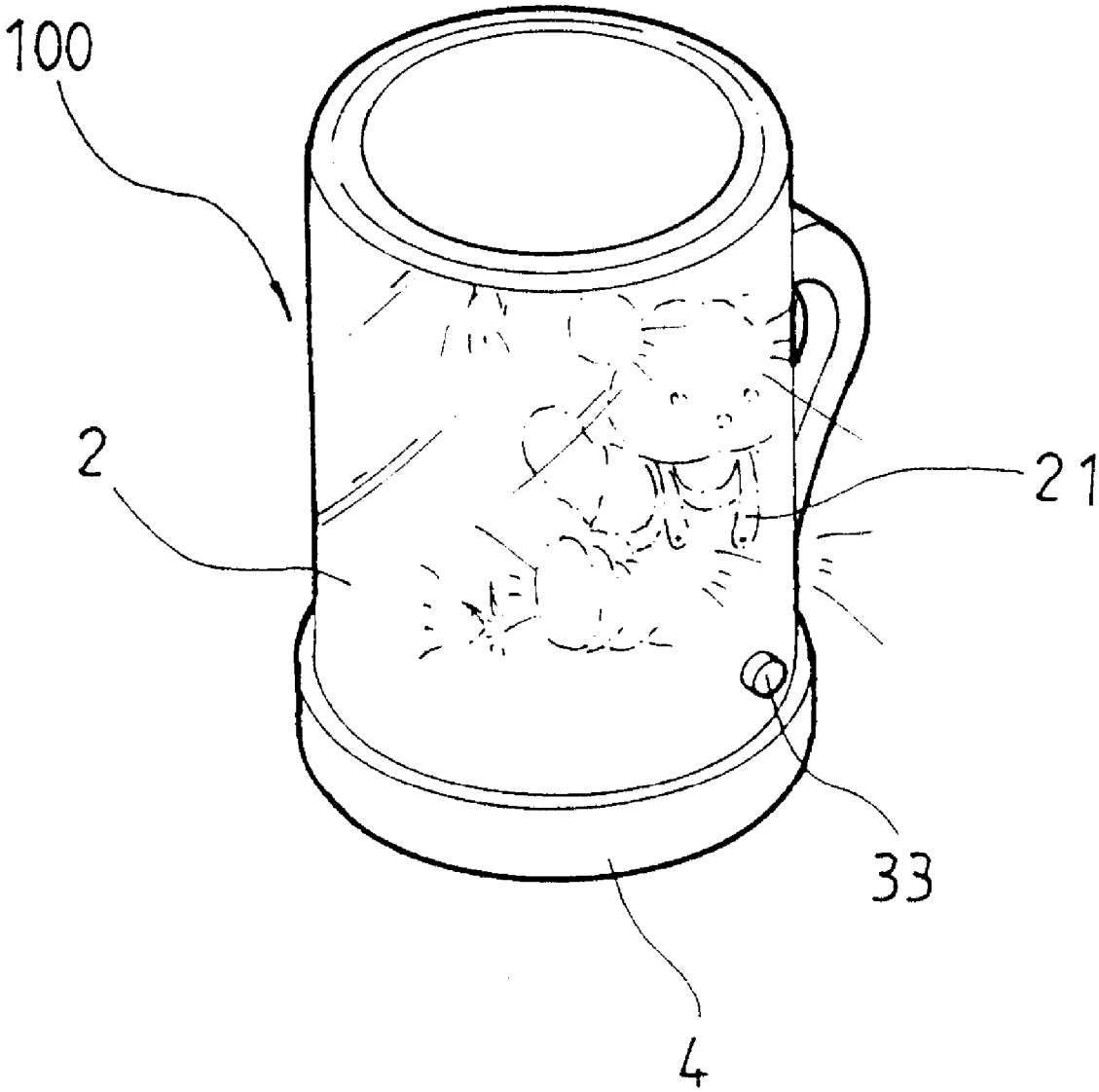
FIG. 4 shows the cup of the present invention in a state of showing luminous images.

FIG. 3 shows the cup 100 with the power switch 33 in the OFF position. In this case, the luminous strip 2 is not lightened and the pictures, words or patterns 21 on the luminous strip 2 are visible through the body 1. FIG. 4 shows the cup 100 with the power switch 33 in the ON position. In this case, the luminous strip 2 is driven by the driving circuit 3 to produce cold light at specific areas showing the pictures, words or patterns 21. When the produced cold light is refracted when it passes through the outer wall of the body 1, the pictures, words or patterns 21 presents luminous and three-dimensional images that are visible at any place and form a good decoration on the cup 100 to increase the value of the cup 100.

In the illustrated embodiment of the present invention, the power switch 33 is a push-button switch, and the vibrating-type switch 34 is a tubular switch. However, it is understood that other types of switch may be employed to provide the same function and should therefore be included in the scope of the present invention.

Figure 5:
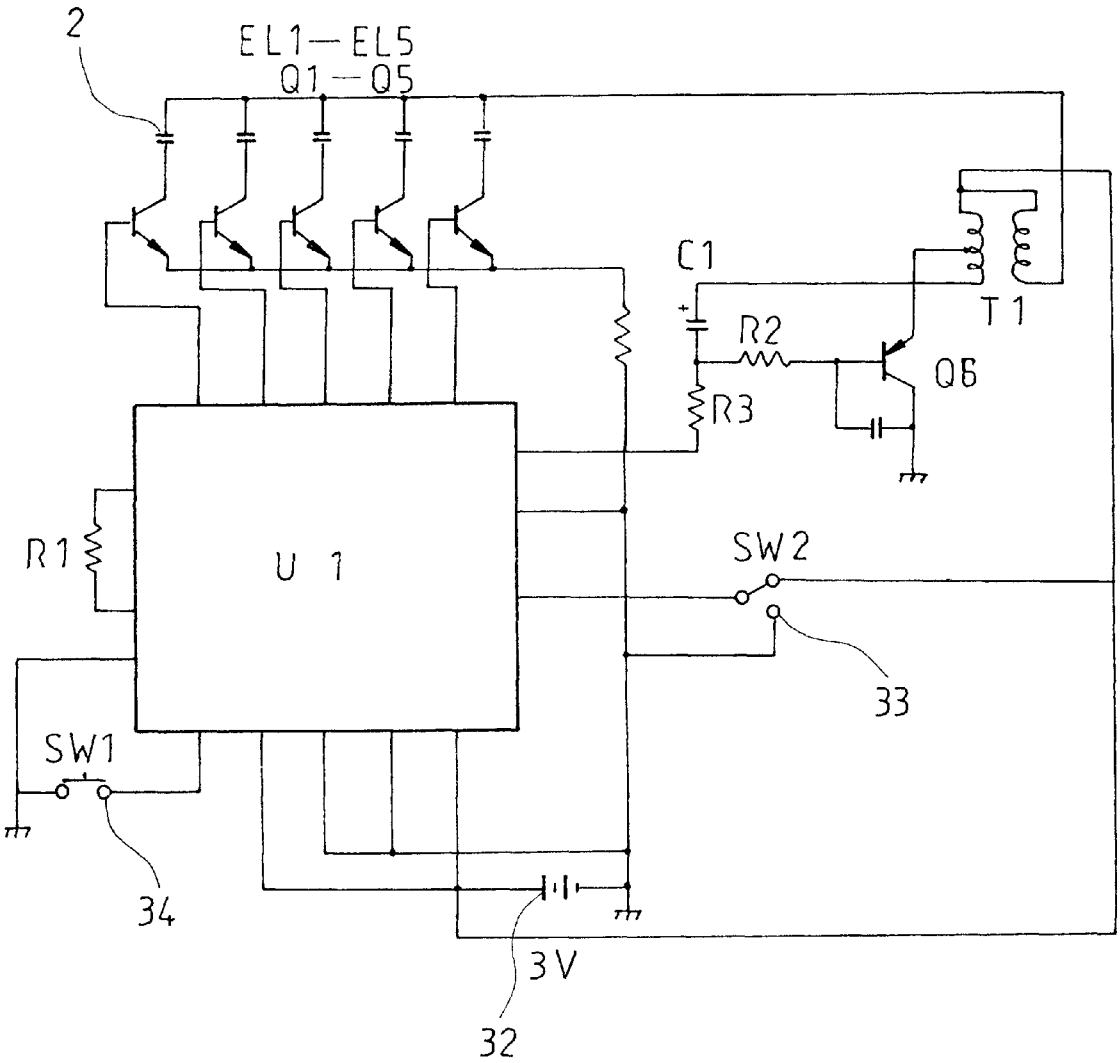
FIG. 5 is a circuit diagram for a preferred embodiment of the present invention.

FIG. 5 is a circuit diagram for a preferred embodiment of the present invention. As indicated by FIG. 5, the circuit of the present invention includes a single chip U1 connected to a plurality of crystals Q1~Q5 and a high-voltage converting circuit consisting of a crystal Q6 and a transformer T1 for driving luminous strips EL1~EL5. The single chip U1 is also connected to a power switch 33 and parallelly connected to another vibrating-type switch 34. Whereby when the power switch 33 is turned on and the cup 100 is vibrated, the vibrating-type switch 34 is made to lighten the luminous strips EL1~EL5; and when the cup 100 is in a static condition, the luminous strips are not lightened.

In brief, the present invention provides a cup having a hollow wall in which a luminous strip having printed patterns is positioned. When the luminous strip is lightened, cold light produced at the printed patterns on the cup creates a three-dimensional visual effect, making the cup more valuable for use.

What is claimed is:

1. A cup showing luminous images, comprising:

a double-walled body having an inner and an outer wall spaced to define an annular hollow space therebetween;

a bottom sealing a lower end of said body and said annular hollow space, said bottom having an elongated through opening formed at a predetermined position in said bottom;

an open-bottomed chamber formed below said bottom by a downward extension of said outer wall of said body for a predetermined distance, and said elongated through opening in said bottom providing open communication between said chamber and said annular hollow space;

a luminous strip with printed pictures, words or patterns being enclosed in said annular hollow space and having conductors extending therefrom and passing through said elongated through opening in said bottom into said chamber; and a driving circuit mounted in said chamber and electrically connected to said luminous strip via said conductors, to generate an energizing voltage for said luminous strip to produce light that passes through and is refracted by said outer wall of said body to create three-dimensional images, on said body, said driving circuit including (a) a high voltage converting circuit for generating said energizing voltage, (b) an integrated circuit having an output coupled to said high voltage converting circuit for operatively driving said high voltage converting circuit, (c) a power switch exposed through an opening formed in said outer wall of said body and coupled to a first input of said integrated circuit for controlling power supplied thereto, and (d) a vibration responsive switch coupled to a second input of said integrated circuit for enabling said energizing voltage generation responsive to, said cup being vibrated to thereby illuminate said luminous strip in correspondence with said vibration.

2. The cup showing luminous images as claimed in claim 1, wherein said chamber is provided with screw threads on a lower peripheral wall surface, and said cup further comprising a lower cover detachably engaged with said screw threads of said chamber to complete said cup.

* * * * *